US011543085B1

(12) United States Patent
Lei

(10) Patent No.: US 11,543,085 B1
(45) Date of Patent: Jan. 3, 2023

(54) GLASS STEM FOR HIGHLY WATERPROOF LED FILAMENT LAMP AND LAMP BULB

(71) Applicant: Dongguan Yicheng Lighting Tech Co., Ltd., Guangdong (CN)

(72) Inventor: Jianwen Lei, Guangdong (CN)

(73) Assignee: Dongguan Yicheng Lighting Tech Co., Ltd., Guangdong (CN)

( * ) Notice: Subject to any disclaimer, the term of this patent is extended or adjusted under 35 U.S.C. 154(b) by 0 days.

(21) Appl. No.: 17/806,744

(22) Filed: Jun. 14, 2022

(30) Foreign Application Priority Data

Jul. 6, 2021 (CN) ..... 202121532959.1

(51) Int. Cl.
*F21K 9/237* (2016.01)
*F21V 31/00* (2006.01)
*F21K 9/232* (2016.01)

(52) U.S. Cl.
CPC ..... *F21K 9/237* (2016.08); *F21K 9/232* (2016.08); *F21V 31/005* (2013.01)

(58) Field of Classification Search
CPC ..... F21K 9/232; F21K 9/237; F21V 31/005; F21V 23/06
See application file for complete search history.

(56) References Cited

U.S. PATENT DOCUMENTS

| | | | | |
|---|---|---|---|---|
| 11,293,596 | B1 * | 4/2022 | Wang | F21K 9/238 |
| 11,293,599 | B1 * | 4/2022 | Wang | F21V 31/005 |
| 2021/0080063 | A1 * | 3/2021 | Lei | F21K 9/232 |
| 2021/0262620 | A1 * | 8/2021 | Lin | F21V 23/06 |

* cited by examiner

*Primary Examiner* — Karabi Guharay
(74) *Attorney, Agent, or Firm* — MagStone Law, LLP; Enshan Hong

(57) ABSTRACT

A glass stem for a highly waterproof LED filament lamp comprises an LED filament, a glass flare tube, an exhaust tube, a first lead wire having a resistance element, and a second lead wire. The first lead wire is placed in the middle of the exhaust tube. The first lead wire, the second lead wire, the top of the exhaust tube and the top of the glass flare tube are fusion-bonded together. A lower section of the exhaust tube is fused and cut off to an assembly-desired length and then fusion-sealed with the first lead wire to form a glass stem with the resistance element sealed in the middle of the exhaust tube. The first lead wire having the resistance element is disposed inside the exhaust tube, such that isolative insulation is generated between the first lead wire and a second lead wire.

7 Claims, 3 Drawing Sheets

GLASS STEM FOR HIGHLY WATERPROOF LED FILAMENT LAMP AND LAMP BULB

TECHNICAL FIELD

The present application relates to the field of LED illumination technologies, particularly to a glass stem for a highly waterproof LED filament lamp and a lamp bulb.

BACKGROUND

An existing LED lamp bulb usually includes a lamp cap, a lampshade, and an LED light source fixed inside the lampshade. At present, the LED lamp bulb generally has one defect, namely, the assembly has insufficient sealing. Therefore, regardless of location, moisture may easily penetrate inside from the lower end of the lamp cap, leading to short-circuiting of the LED lamp bulb. If the LED lamp bulb is required to achieve the waterproof performance of IP65 or higher, glue is generally filled into the lamp cap to achieve negative and positive pole insulation, and thus it is difficult to control.

SUMMARY OF THE INVENTION

For the existing technical problems, the present application provides a glass stem for a highly waterproof LED filament lamp and a lamp bulb.

To solve the above technical problems, the present application adopts the following technical solution.

There is provided a glass stem for a highly waterproof LED filament lamp, including an LED filament, a glass flare tube, an exhaust tube, a first lead wire having a resistance element, and a second lead wire. The first lead wire is placed in the middle of the exhaust tube. The first lead wire, the second lead wire, the top of the exhaust tube and the top of the glass flare tube are fusion-bonded together at a high temperature. A lower section of the exhaust tube is fused and cut off to an assembly-desired length and then fusion-sealed with the first lead wire at a high temperature to form a glass stem with the resistance element sealed in the middle of the exhaust tube. The LED filament is fixedly welded between the first lead wire and the second lead wire both protruding out of the glass stem.

Preferably, a high and low temperature-resistant rubber plug is sleeved on an outer side of the glass stem. A through-hole matching with a size of an outer diameter of the glass flare tube is opened in the middle of the high and low temperature-resistant rubber plug. The glass flare tube is inserted into the through-hole in an interference fit manner to fixedly connect the high and low temperature-resistant rubber plug with the glass stem.

Furthermore, the high and low temperature-resistant rubber plug is shaped like a frustum or cylinder.

Furthermore, the LED filament is a straight-stripped or soft all-angle luminous filament.

There is provided a highly waterproof LED filament lamp bulb, including a lampshade and a lamp cap, and further including the glass stem for the highly waterproof LED filament lamp as mentioned above. An upper end of the glass stem is located inside the lampshade, and a lower end of the glass stem is fixedly connected with the lamp cap.

Furthermore, the lampshade is made of glass, the glass flare tube is fusion-bonded with an end of the lampshade at a high temperature to achieve high waterproofness, and a lower end of the lampshade is fixedly fusion-connected with the lamp cap.

Furthermore, the lampshade is made of plastic, and the high and low temperature-resistant rubber plug is sleeved on the outer side of the glass flare tube and inserted into an end of the plastic lampshade in an interference fit manner. A lower end of the plastic lampshade is provided with a thread connection section, and the plastic lampshade is fixedly connected with the lamp cap through the thread connection section.

The present application has the following beneficial effects.

In the present application, a first lead wire having a resistance element is disposed inside an exhaust tube, such that isolative insulation is generated between the first lead wire and a second lead wire easily. Further, the top and bottom ends of the exhaust tube are fused and sealed at a high temperature to achieve protective insulation for the resistance element. The high-temperature fusion sealing of the top end of the glass flare tube and the high-temperature fusion sealing of the lower end of the exhaust tube can effectively prevent moisture from entering the interior of the lampshade from the lower end of the glass stem. After the lampshade and the lamp cap are fixed, moisture will be prevented from entering the interior of the lampshade, and thus the lamp bulb will achieve full waterproofness, increasing the entire waterproof performance.

Figure 1:
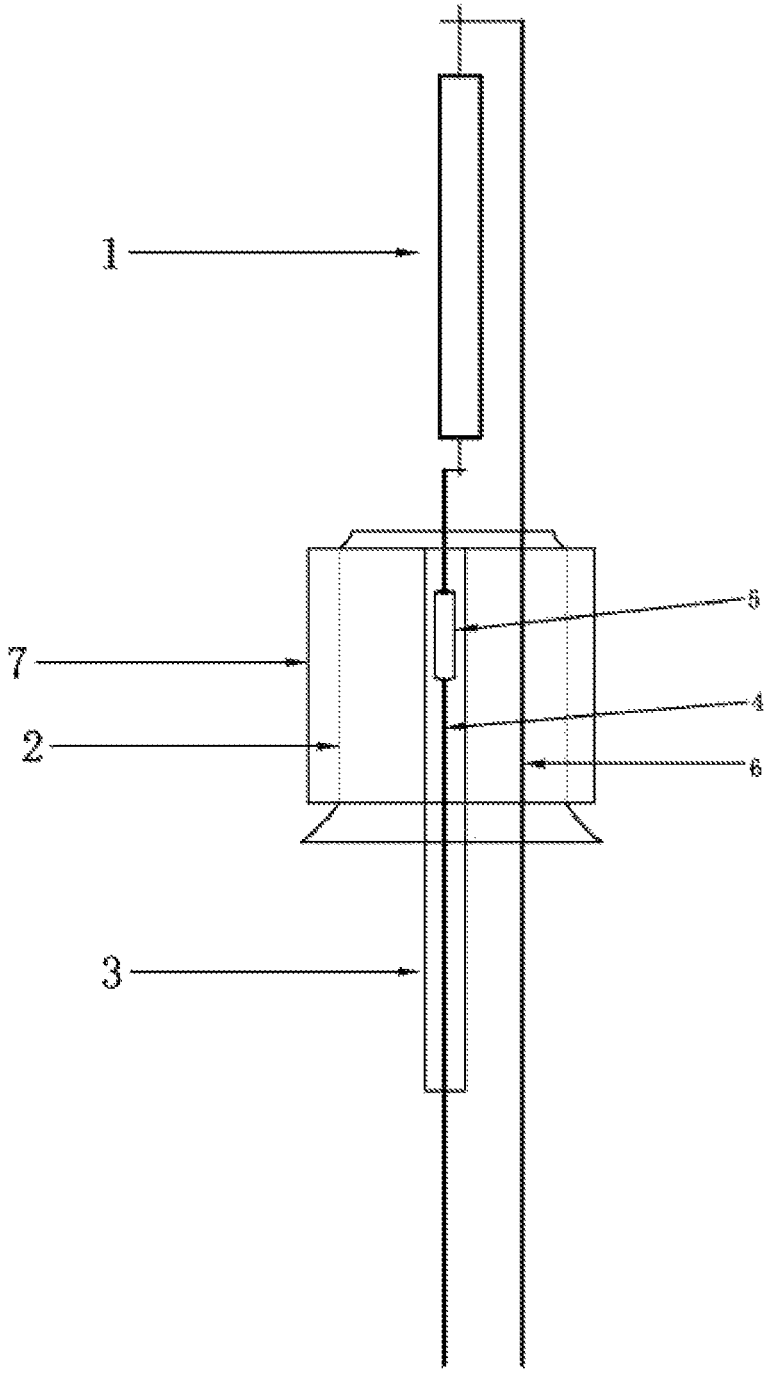
FIG. 1 is a structural schematic diagram illustrating a glass stem for a highly waterproof LED filament lamp.
Figure 2:
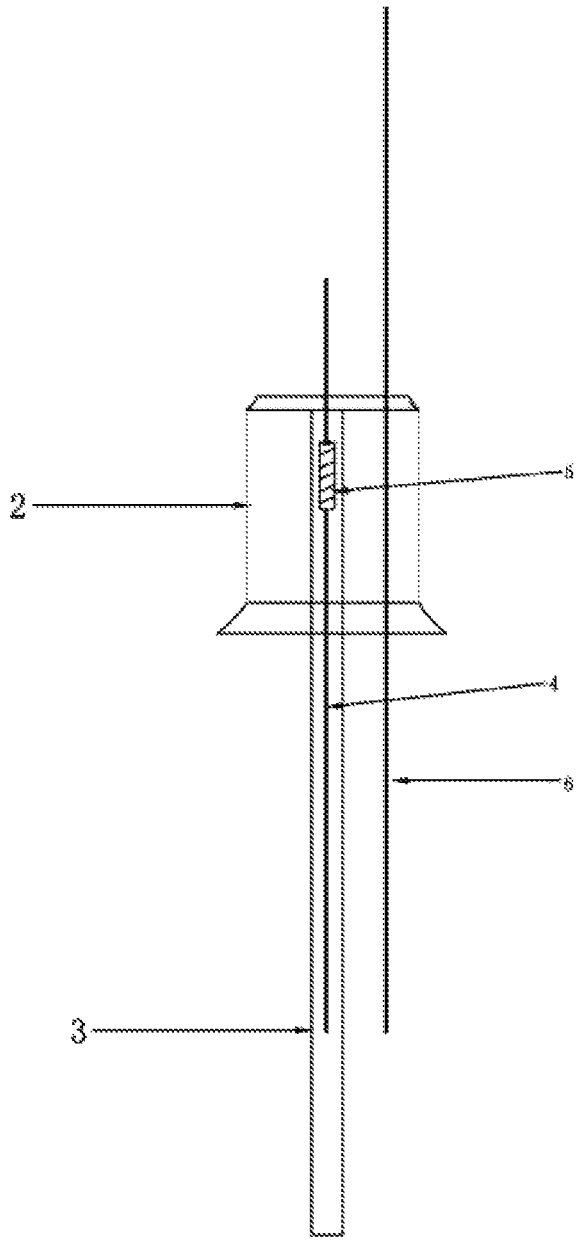
FIG. 2 is a structural schematic diagram illustrating a glass stem without an LED filament welded.
Figure 3:
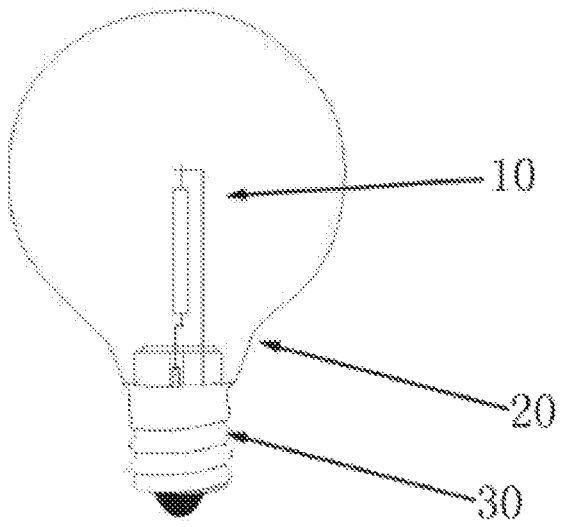
FIG. 3 is a structural schematic diagram illustrating a highly waterproof LED filament lamp bulb.

Numerals of drawings 1 to 3 are described below:

1—LED filament, 2—glass flare tube, 3—exhaust tube, 4—first lead wire, 5—resistance element, 6—second lead wire, 7—high and low temperature-resistant rubber plug, 10—glass stem, 20—lamp shade, and 30—lamp cap.

DETAILED DESCRIPTION OF PREFERRED EMBODIMENTS

To help understanding of those skilled in the art, the present application will be further described below in combination with specific embodiments and drawings. The contents mentioned in the embodiments are not intended to limit the present application. Detailed descriptions are made below of the present application in combination with accompanying drawings.

The present application provides a glass stem for a highly waterproof LED filament lamp, including an LED filament 1, a glass flare tube 2, an exhaust tube 3, a first lead wire 4 having a resistance element 5, and a second lead wire 6. The first lead wire 4 is placed in the middle of the exhaust tube 3, and the first lead wire 4, the second lead wire 6, the top of the exhaust tube 3 and the top of the glass flare tube 2 are fusion-bonded together at a high temperature. A lower section of the exhaust tube 3 is fused and cut off to an assembly-desired length and then fusion-sealed with the first lead wire 4 at a high temperature to form a glass stem 10 with the resistance element 5 sealed in the middle of the exhaust tube 3. The exhaust tube 3 performs positive and negative pole insulation for the resistance element 5 to effectively prevent moisture from performing electrode connection with the second lead wire 6. The LED filament 1 is fixedly welded between the first lead wire 4 and the second lead wire 6 both protruding out of the glass stem 10.

As a first implementation solution, there is provided a highly waterproof LED filament lamp bulb, including a lampshade 20 and a lamp cap 30, and further includes the glass stem 10 for the highly waterproof LED filament lamp as mentioned above. An upper end of the glass stem 10 is located inside the lampshade 20 and a lower end of the glass stem 10 is fixedly connected with the lamp cap 30. Furthermore, the lampshade 20 is a glass lampshade, the glass flare tube 2 is fusion-bonded with an end of the lampshade 20 at a high temperature to achieve high waterproofness, and a lower end of the lampshade 20 is fixedly fusion-connected with the lamp cap 30.

In the first implementation solution, the first lead wire 4 having the resistance element 5 is disposed inside the exhaust tube 3, such that isolative insulation is generated between the first lead wire 4 and a second lead wire 6 easily. Further, the top and bottom ends of the exhaust tube 3 are fused and sealed at a high temperature to achieve protective insulation for the resistance element 5. The high-temperature fusion sealing of the top end of the glass flare tube 2 and the high-temperature fusion sealing of the lower end of the exhaust tube 3 can effectively prevent moisture from entering the interior of the lampshade from the lower end of the glass stem 10. After the lampshade 20, and the lamp cap 30 are fixed via hot melting, moisture will be prevented from entering the interior of the lampshade 20, and thus the lamp bulb will achieve full waterproofness, increasing the entire waterproof performance.

In a second implementation solution, a high and low temperature-resistant rubber plug 7 is sleeved on an outer side of the glass stem 10. A through-hole matching with a size of an outer diameter of the glass flare tube 2 is opened in the middle of the high and low temperature-resistant rubber plug 7. The glass flare tube 2 is inserted into the through-hole in an interference fit manner to fixedly connect the high and low temperature-resistant rubber plug 7 with the glass stem 10.

Lampshade 20 is plastic, and the high and low temperature-resistant rubber plug 7 is sleeved on the outer side of the glass flare tube 2 and inserted into an end of the plastic lampshade in an interference fit manner. A lower end of the plastic lampshade is provided with a thread connection section, and the plastic lampshade is fixedly connected with the lamp cap 30 through the thread connection section. The threaded connection of the lampshade 20 and the lamp cap 30 by the thread connection section is structurally simple, which helps to carry out production using automatic equipment.

In this embodiment, the lampshade 20 is made in an injection molding process. The plastic lampshade is used to replace the traditional glass lamp shade and thus it is no need to heat and sinter glass, greatly saving production energy. Plastic is difficult to break and thus has higher safety than glass. The high and low temperature-resistant rubber plug 7 has the features of insulation and heat resistance and is difficult to deform. During an assembly process, the high and low temperature-resistant rubber plug 7 and the glass stem 10 are assembled in an interference fit manner. When the glass stem 10 is fixed inside the lampshade 20, the lower end of the lampshade 20 is seal-plugged by the high and low temperature-resistant rubber plug 7.

Furthermore, the high and low temperature-resistant rubber plug 7 is shaped like a frustum or cylinder. The thread connection section disposed at the lower end of the plastic lampshade is generally cylindrical. The frustum-shaped or cylinder-shaped high and low temperature-resistant rubber plug 7 is inserted into the thread connection section in an interference fit manner, achieving firm insertion and sealing effect.

Preferably, the LED filament 1 is a straight-stripped or soft all-angle luminous filament which can provide a better illumination effect close to an incandescent lamp.

The above descriptions are merely made to preferred embodiments of the present application and are not meant to limit the present application in any form. Although the preferred embodiments of the present application are described above, these preferred embodiments are not used to limit the present application. Some changes or modifications made by those skilled in the art based on the above technical contents without departing from the scope of protection of the present application are equivalent embodiments of equivalent changes. Any simple modifications, equivalent changes, and modifications made to the above embodiments without departing from the contents of the technical solutions of the present application shall all fall within the scope of protection of the present application.

What is claimed is:

1. A glass stem for a waterproof LED filament lamp, comprising: an LED filament, a glass flare tube, an exhaust tube, a first lead wire having a resistance element, and a second lead wire, wherein the first lead wire is placed in the middle of the exhaust tube, the first lead wire, the second lead wire, the top of the exhaust tube and the top of the glass flare tube are fusion-bonded together, a lower section of the exhaust tube is fused and cut off to an assembly-desired length and then fusion-sealed with the first lead wire to form a glass stem with the resistance element sealed in the middle of the exhaust tube, and the exhaust tube performs positive and negative pole insulation for the resistance element to prevent moisture from performing electrode connection with the second lead wire; and the LED filament is fixedly welded between the first lead wire and the second lead wire both protruding out of the glass stem.

2. The glass stem for the waterproof LED filament lamp according to claim 1, wherein a temperature-resistant rubber plug is sleeved on an outer side of the glass stem, a through-hole matching with a size of an outer diameter of the glass flare tube is opened in the middle of the temperature-resistant rubber plug, the glass flare tube is inserted into the through-hole in an interference fit manner to fixedly connect the temperature-resistant rubber plug with the glass stem.

3. The glass stem for the waterproof LED filament lamp according to claim 2, wherein the temperature-resistant rubber plug is shaped like a frustum or cylinder.

4. The glass stem for the waterproof LED filament lamp according to claim 1, wherein the LED filament is a straight-stripped or soft all-angle luminous filament.

5. A waterproof LED filament lamp bulb, comprising a lampshade and a lamp cap, and further comprising the glass stem for the waterproof LED filament lamp according to claim 1, wherein an upper end of the glass stem is located inside the lampshade and a lower end of the glass stem is fixedly connected with the lamp cap.

6. The waterproof LED filament lamp bulb according to claim 5, wherein the lampshade is a glass lampshade, the glass flare tube is fusion-bonded with an end of the lampshade to achieve waterproofness, and a lower end of the lampshade is fixedly fusion-connected with the lamp cap.

7. The waterproof LED filament lamp bulb according to claim 5, wherein the lampshade is a plastic lampshade, the temperature-resistant rubber plug is sleeved on the outer side of the glass flare tube and inserted into an end of the plastic lampshade in an interference fit manner, a lower end of the plastic lampshade is provided with a thread connection section, and the plastic lampshade is fixedly connected with the lamp cap through the thread connection section.

* * * * *